US006811574B2

(12) United States Patent
Baumann et al.

(10) Patent No.: US 6,811,574 B2
(45) Date of Patent: Nov. 2, 2004

(54) METHOD OF AFTER-TREATMENT OF A DYEABLE NYLON TEXTILE SURFACE WITH A STAIN RESIST AND THE ARTICLE PRODUCED THEREBY

(75) Inventors: Markus Baumann, Wiesloch (DE); Helen Frances Latham, Croston, Leyland (GB)

(73) Assignee: DuPont Textiles & Interiors, Inc., Wilmington, DE (US)

( * ) Notice: Subject to any disclaimer, the term of this patent is extended or adjusted under 35 U.S.C. 154(b) by 42 days.

(21) Appl. No.: 10/038,404

(22) Filed: Jan. 2, 2002

(65) Prior Publication Data

US 2002/0144353 A1 Oct. 10, 2002

Related U.S. Application Data

(63) Continuation-in-part of application No. PCT/US00/18589, filed on Jul. 7, 2000.

(51) Int. Cl.[7] ..... D06P 5/08; D06P 3/87

(52) U.S. Cl. ..... 8/444; 8/151; 8/485; 8/531; 8/495; 8/539; 427/322; 427/393.4; 427/430.1

(58) Field of Search ..... 8/151, 485, 531, 8/539, 495, 444; 427/393.4, 430.1, 322

(56) References Cited

U.S. PATENT DOCUMENTS

| | | | | |
|---|---|---|---|---|
| 4,005,230 | A | | 1/1977 | Fleissner |
| 4,043,749 | A | * | 8/1977 | Huffman |
| 4,075,378 | A | * | 2/1978 | Anton et al. |
| 4,501,591 | A | | 2/1985 | Ucci et al. |
| 4,592,940 | A | | 6/1986 | Blyth et al. |
| 4,780,099 | A | | 10/1988 | Greschler et al. |
| 4,940,757 | A | | 7/1990 | Moss, III et al. |
| 5,131,918 | A | * | 7/1992 | Kelley |
| 5,135,774 | A | | 8/1992 | Calcaterra et al. |
| 5,229,483 | A | | 7/1993 | Fitzgerald |
| 5,252,375 | A | | 10/1993 | Turbak et al. |
| 5,447,755 | A | | 9/1995 | Pechhold et al. |
| 5,460,891 | A | | 10/1995 | Buck et al. |
| 5,549,963 | A | * | 8/1996 | Elgarhy et al. |
| 5,681,620 | A | * | 10/1997 | Elgarhy |
| 5,851,595 | A | | 12/1998 | Jones, Jr. |
| 5,925,149 | A | * | 7/1999 | Pacifici et al. |
| 6,387,448 | B1 | * | 5/2002 | Collier et al. |

FOREIGN PATENT DOCUMENTS

| | | |
|---|---|---|
| EP | 0 107 221 | 5/1984 |
| EP | 0 235 980 | 9/1987 |
| EP | 0 661 397 A2 | 7/1995 |
| EP | 735 181 | 2/1997 |
| WO | WO 89/02949 | 4/1989 |
| WO | WO97/01665 | 1/1997 |

OTHER PUBLICATIONS

XP000160169, Stain–Resist Application Process, Research Disclosure #319, Nov. 1990.
XP000168093, Stain Blockers for Nylon Fibers, Rev. Prog. Coloration vol. 20, 1990.

* cited by examiner

*Primary Examiner*—Margaret Einsmann
(74) *Attorney, Agent, or Firm*—Connolly Bove Lodge & Hutz LLP; Myron K. Wyche

(57) ABSTRACT

A method of treating articles having a textile surface (such as broadloom carpets or carpet tiles) with a stainblocker composition is disclosed. After coloring, a stainblocker composition having a temperature from twenty to ninety-five degrees Celsius (20 to 95° C.) is applied. If the articles are carpet tiles, the stainblocker is applied using a flood process. The article is dried in a drying zone having a temperature in the range from seventy-five degrees Celsius to ninety-five degrees Celsius (75–95° C.) for a time sufficient to allow the stainblocker composition to react with the nylon yarn in the textile surface. Preferably, an infra-red oven is used to define the drying zone.

17 Claims, 3 Drawing Sheets

METHOD OF AFTER-TREATMENT OF A DYEABLE NYLON TEXTILE SURFACE WITH A STAIN RESIST AND THE ARTICLE PRODUCED THEREBY

CROSS REFERENCE TO RELATED APPLICATION

This application is a continuing application based upon the priority of PCT/US 00/18589 designating the United States of America, filed Jul. 7, 2000, which is itself based upon the priority of EP Application 00114226.4, filed Jul. 3, 2000 (RD-8025 EPO).

BACKGROUND OF THE INVENTION

1. Field of the Invention

The invention relates to a continuous method for treating an article having a textile surface , such as a broadloom carpet or carpet tiles, with a stainblocker composition to impart stain resistance thereto, and to the article produced thereby.

2. Description of the Prior Art

In the industrial production of articles having a textile surface thereon, such as a broadloom carpet or carpet tiles, it is common to treat such articles with a composition to impart added desirable properties thereto, such as resistance to staining by a variety of agents, e.g. foods or beverages. Some especially troublesome stains are coffee, black tea and red wine.

In the industrial production of such articles it is also common to use differentially dyeable nylon yarns. By the term "differentially dyeable" it is meant that the article contains yarns having at least two different dyeabilities, such as acid dyeable yarn and cationic ("cat") dyeable yarn. Often a desired aesthetic effect in a carpet is possible only by combining yarns of these two different dyeabilities. Both dyeabilities are available in various dye depths, such as light, regular, deep and extra deep acid dye and light and regular cat dye.

Compositions referred to as "stainblockers" are commonly applied to non-differentially dyeable carpets or carpet tiles to impart stain resistance.

There is presently available both a continuous process and a discontinuous, or batch-wise, process for applying a stainblocker composition to a carpet made of non-differentially dyeable yarns.

Continuous Conventional Process The steps of a conventional process for applying a stainblocker composition to a textile surface (such as a broadloom carpet) made of non-differentially dyeable yarns are listed along the left hand side in FIG. 3. In the conventional continuous process a running line of colored carpet (colored as by dyeing or printing), after rinsing and suction hydroextraction, is passed through an aqueous liquid treatment bath containing a stainblocker composition and a surfactant. The temperature of the bath is in the range from twenty to sixty degrees Celsius (20 to 60°C.). The residence time of the carpet in the bath is usually not adjusted as an independent critical parameter but is instead a function of the speed of the carpet line. After removal from the bath the carpet passes through a steam chamber wherein it is exposed to saturated steam for about sixty to ninety (60 to 90) seconds. Thereafter, conventional finishing steps for the carpet typically include: a suction hydroextraction operation where residual liquid is vacuumed from the carpet; a cold water rinse operation (either by spraying or passing the carpet through a dip trough); another suction hydroextraction operation; and a final drying.

Batch-wise Conventional Process The batch-wise process for applying the stainblocker composition and a surfactant to a textile surface made of non-differentially dyeable yarns (such as a broadloom carpet) is termed the "winch/beck" process. In the batch-wise winch/beck process discrete dyed carpets are immersed in a vat having a bath including a stainblocker composition and a surfactant. The temperature of the bath in the batch-wise winch/beck process is slightly higher than in the continuous process, in the range from seventy to seventy-five degrees Celsius (70 to 75°C.), and the residence time in the bath is on the order of twenty minutes. After removal from the bath, the carpet is subjected to the conventional finishing steps such as rinsing with cold water in situ, or after unloading from the hot application bath, rinsed by spray bar followed by a vacuum extraction operation to ensure no residual stainblocker is left.

In both the continuous process and the batch-wise process the stainblocker composition is preferably of the anionic functionalized type, and more preferably, of the sulphone resole type having nonionic functionality.

Tile Production To produce carpet tiles treated with a stainblocker composition it is common practice first to treat a broadloom carpet with a stainblocker composition in one of the manners specified, and after a backing is applied, to cut the broadloom carpet into pieces of the desired size to form carpet tiles.

Stainblockers Suitable anionic functionalized type stainblocker compositions include sulphonated phenol formaldehyde condensate types, maleic acid anhydride types, acrylate dispersions and mixtures thereof. Anionic functionalized type stainblocker compositions should be present between three weight percent (3 wt %) and five weight percent (5 wt. %) based on the weight of the nylon carpet fiber. When anionic functionalized type stainblocker compositions are used, the pH of the bath must be adjusted to between 2 and 5.

Examples of commercially available anionic functionalized type stainblocker compositions are available from E. I. Du Pont de Nemours and Company, Wilmington, Del., under the trademarks SR 300, SR 400 and SR 500; from Du Pont de Nemours International S. A., Geneva, Switzerland, under the trademark NRD 334; from Allied Colloids, Bradford/West Yorkshire, U.K., under the trademark Alguard RD; and from Bayer AG, Leverkusen, Germany, under the trademark Baygard DT.

When sulphone resole type stainblocker compositions with nonionic functionality are used, they should be present at between four weight percent (4 wt. %) and six weight percent (6 wt. %) based on the weight of the nylon carpet fiber, and the pH must be adjusted to between 6 and 7.5. An example of a commercially available sulphone resole type stainblocker composition with nonionic functionality is available from E. I. Du Pont de Nemours and Company, Wilmington, Del. under the trademark Zelan 8236.

The pH of the treatment bath may be adjusted by known acid donor additives such as acetic acid, citric acid and sulfamic acid.

Surfactants A surfactant may be added to the stainblocker bath separately or may be included as part of the stainblocker composition. The surfactant may be anionic, amphoteric or nonionic in nature. Preferably, the surfactant used will be either an alkylated diphenyl oxide disulfonate sodium salt, alone or in combination with an alkylnaphtalene sulfonic acid formaldehyde condensate sodium salt. The surfactant is generally added to the bath at a rate of between one (1) and four (4) grams per liter. Suitable surfactants are available from E. I. Du Pont de Nemours and Company, Wilmington, Del. under the trademark Zelan 50; from Dow Chemical Company, Midland, Mich., under the trademark Dowfax 3B2; or from BASF AG, Ludwigshafen, Germany, under the trademark Primasol NF.

Problem With Conventional Methods for Differentially Dyeable Textile Surfaces Unfortunately, when either the continuous process or the batch-wise process is used to apply a stainblocker composition to a broadloom carpet containing differentially dyeable yarns the cationic dyestuff "bleeds" from the cat dyeable yarn into the surrounding stainblocker treatment bath, resulting in an unacceptable visual color change.

Low Liquor Method The only publicly known system to apply a stainblocker composition to a differentially dyeable carpet is a method known as the "low liquor" method. Using the "low liquor" method a differentially dyeable carpet may attain at least a modest degree of stain resistance. In the "low liquor" method a cold-foamed liquor including a stainblocker composition and a fluorocarbon material are co-applied topically to the carpet. Thereafter the carpet is dried, without steam or water rinse. In the past, the stainblocker composition typically utilized was the acrylate dispersion sold by 3M Corporation under the trademark "FX-661", while the fluorocarbon material typically utilized was those sold by 3M Corporation under the trademarks "FC-3611", "FC-3602" or "FC-1395". However, the low liquor method is useful only with a carpet having a very low "wet pick-up", on the order of fifteen to twenty percent (15–20%). Wet pick-up (wpu) is the ratio of the weight of the liquid picked-up by the carpet from a treatment bath to the weight of the carpet. Moreover, with the low liquor method, the stainblocker composition penetrates into only about the upper twenty-five percent (25%) of the height of the pile elements of a differentially dyeable carpet. This depth of stainblocker penetration is not believed to be sufficient to impart a high degree of stain resistance.

Accordingly, in view of the foregoing, it is believed advantageous to provide a process for treating an article having a textile surface containing differentially dyeable nylon yarns, such as a broadloom carpet or carpet tiles, to impart a high degree of stain resistance thereto, while maintaining good color stability.

SUMMARY OF THE INVENTION

In one a first aspect the present is a method of treating articles having a textile surface (such as broadloom carpets or carpet tiles) with a stainblocker composition to impart stain resistance thereto. The textile surface of the articles may be made of either differentially dyeable nylon yarns or acid-dyeable nylon yarns.

The textile surface of the article is colored with acid dyestuffs and cationic dyestuffs (in the case of an article made of differentially dyeable nylon yarns) or with acid dyestuffs (in the case of an article made of acid-dyeable nylon yarns). The coloring may be accomplished either by dyeing or by screen or spray printing. After coloring, this embodiment of the method comprises the sequential steps of:

(a) applying a stainblocker composition to the textile surface of the article, the stainblocker composition having a temperature from twenty to ninety-five degrees Celsius (20 to 95° C.);

(b) drying the article in a drying zone having a temperature in the range from seventy-five degrees Celsius to ninety-five degrees Celsius (75–95° C.) for a time sufficient to allow the stainblocker composition to react with the nylon yarn in the textile surface; and (c) rinsing the textile surface of the article with water, and thereafter drying the same, such that substantially the entire textile surface of the article is coated with a stainblocker composition whereby the textile surface has a stain resistance of 9 or higher on the AATCC Red 40 Stain Scale.

A broadloom carpet (with the backing thereon) may be cut into pieces to form carpet tiles either before or after it is colored, or after the final drying step.

When the article is in the form of carpet tiles, the tiles lay loosely upon and are conveyed by a transport belt through the stainblocker application. For carpet tiles the stainblocker composition is applied using a flood process by a flood applicator. Broadloom carpets may be transported by any suitable transport mechanism and the stainblocker composition can be applied by any appropriate application device.

Preferably, the drying zone of step c) uses infra-red energy to dry the textile article. Preferably, the temperature of the drying zone is in the range from eighty degrees Celsius to eighty-five degrees Celsius (80–85° C.).

If the stainblocker composition is of the sulphone resole type having nonionic functionality (as is preferred) the stainblocker composition is present between one and one-half percent (1.5%) and six percent (6%), and more preferably, between two percent (2%) and three percent (3%) or between one and one-half percent (1.5%) and two (2%) percent, based on the weight of the nylon yarns. The pH of the stainblocker bath is between six (6) and seven and one-half (7.5). Alternatively, if the stainblocker composition is of the anionic functionalized type, such as that selected from the group consisting of sulphonated phenol formaldehyde condensate type, maleic acid anhydride type, acrylate dispersions and mixtures thereof, the stainblocker is present between one percent (1%) and five percent (5%) based on the weight of the nylon yarns; and the pH of the stainblocker bath is between two (2) and five (5).

-o-0-o-

In accordance with another aspect the invention is also directed to the article having a textile surface treated with the stainblocker composition in accordance with the method described herein.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
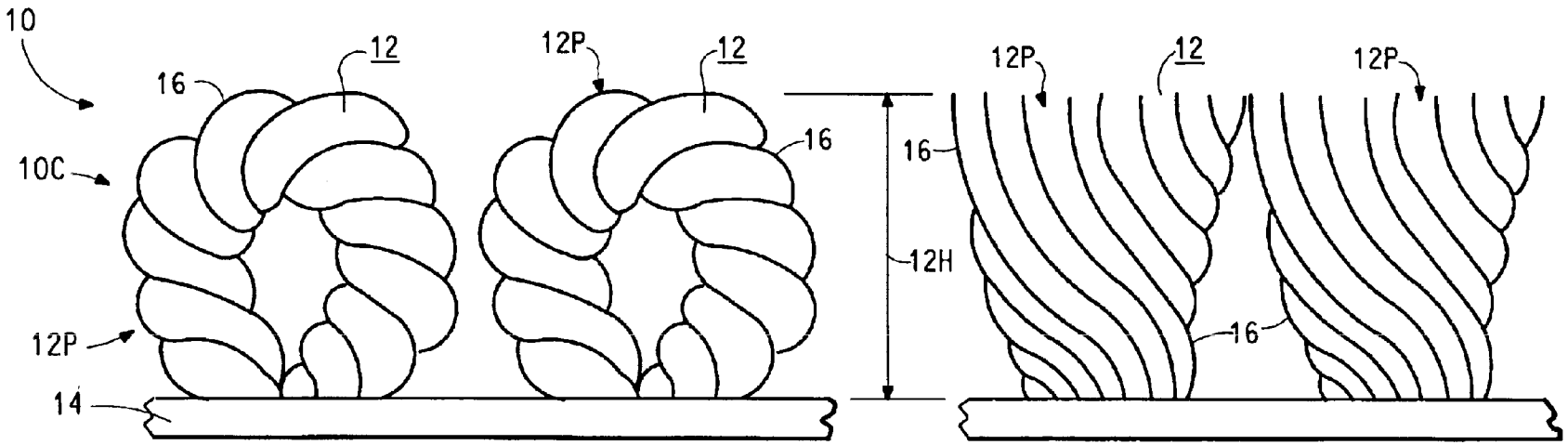
FIG. 1 is a side view of a pile surface structure in accordance with the present invention.

Throughout the following detailed description similar reference numerals refer to similar elements in all figures of the drawings.

The present invention is broadly directed to a method for applying a stainblocker composition to any article having a textile surface to impart stain resistance thereto and to articles produced thereby. The textile surface may be one that is formed from at least two types of dyeable nylon yarns. At least one type of nylon yarn is dyeable by acid dyestuffs and at least one other type of nylon yarn is dyeable by cationic ("cat") dyestuffs. A textile surface that contains yarns having at least two different dyeabilities, such as cationic dyeable yarn and acid dyeable yarn, is termed "differentially dyeable". Alternatively, the textile surface may be "acid-dyeable", that is, a surface that is formed only from nylon yarns that are dyeable using acid dyestuffs.

In accordance with the present invention the textile surface of the article is coated with a stainblocker composition such that the textile surface has a stain resistance of 9 or higher on the AATCC Red 40 Stain Scale.

The most preferred form of an article 10 in accordance with the present invention is illustrated in FIG. 1. In FIG. 1 the article 10 is embodied by a carpet 10C whose textile surface 12 is defined by a plurality of upstanding pile elements 12P. The pile elements 12P extend above a backing 14. The carpet 10C may be a full broadloom size, or (once the backing is applied) may be cut into the form of "carpet tiles". As is appreciated by those in the art, "carpet tiles" are, in the typical case, generally square pieces of carpet having dimensions on the order of fifty-by-fifty centimeters (50×50 cm.). Of course, tiles may take other shapes and exhibit any desired range of sizes.

As the result of treatment of the carpet 10C (in either broadloom or tile form) with the "infra-red" process to be described herein, substantially the entire height 12H of each pile element 12P has a coating 16 of a stainblocker composition thereon. It should be noted that although in practice the coating 16 of stainblocker composition would be invisible, for purposes of illustration the presence of the coating 16 is represented in FIG. 1 by relatively bold lines on the contours of the pile elements 12P.

Since the textile surface 12 of the carpet 10C illustrated in FIG. 1 is defined by the plurality of upstanding pile elements 12P, the carpet 10C is hereinafter be referred to as a "pile surface structure". This nomenclature serves to distinguish the illustrated pile surface structure 10C from alternative forms of carpet structures in which the textile surface is defined by a textile fabric. These alternative forms of carpet structures also lie within the contemplation of the invention. An example of one such alternative form of carpet structure is the carpet disclosed in International Publication WO 97/01665 (Vinod).

The pile elements 12P defining the textile surface of the pile surface structure 10C may be either cut pile (as illustrated in the right hand portion of FIG. 1) or loop pile (as illustrated in the left hand portion of FIG. 1). The pile elements 12P may be produced by any suitable known carpet forming process, such as tufting, weaving or knitting. In the case of a differentially dyeable pile surface structure, each pile element 12P, however produced, may be comprised entirely of either acid dyeable nylon yarns or cat dyeable nylon yarns. Alternately, each pile element 12P may comprise a combination of both acid dyeable nylon yarns or cat dyeable nylon yarns. The nylon material may be nylon 6,6 or nylon 6 or any of the various copolymers thereof. The yarn is either a bulked continuous filament yarn or a staple spun yarn.

In the case of an acid-dyeable pile surface structure each pile element 12P in the pile surface structure 10C is formed only from nylon yarns that are dyeable using acid-dye.

The backing 14 for the pile surface structure 10C may be implemented using any convenient materials. A preferred backing construction is a synthetic latex/chalk filler compound.

Figure 2:
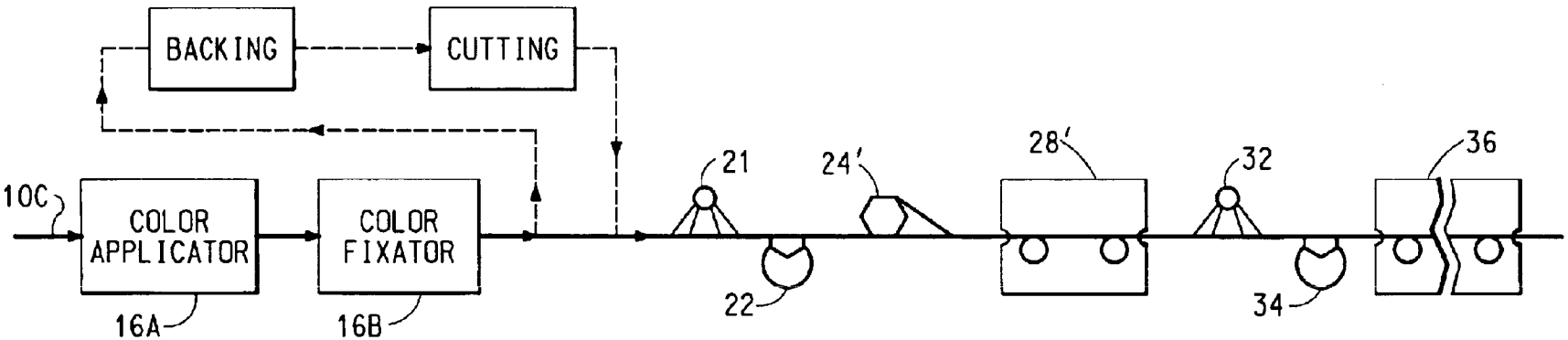
FIG. 2 is a schematic representation of the steps of methods for treating a carpet or carpet tile an article having a textile surface with a stainblocker in accordance with the present invention, wherein the representation (FIG. 2A) of the "hot shock" process of one embodiment of the present invention extends along the upper edge of the drawing sheet, while the representation (FIG. 2B) of the "infra-red" process of another embodiment of the present invention extends along the lower edge of the drawing sheet; and, FIG. 3 is a block diagram representation in which the steps of the "infra-red" process of the present invention shown schematically in FIG. 4B extend along the right hand side of FIG. 3, while the steps of a conventional method for applying a stainblocker composition to a textile surface made of non-differentially dyeable yarns extend along the left hand side of FIG. 3
Figure 3:
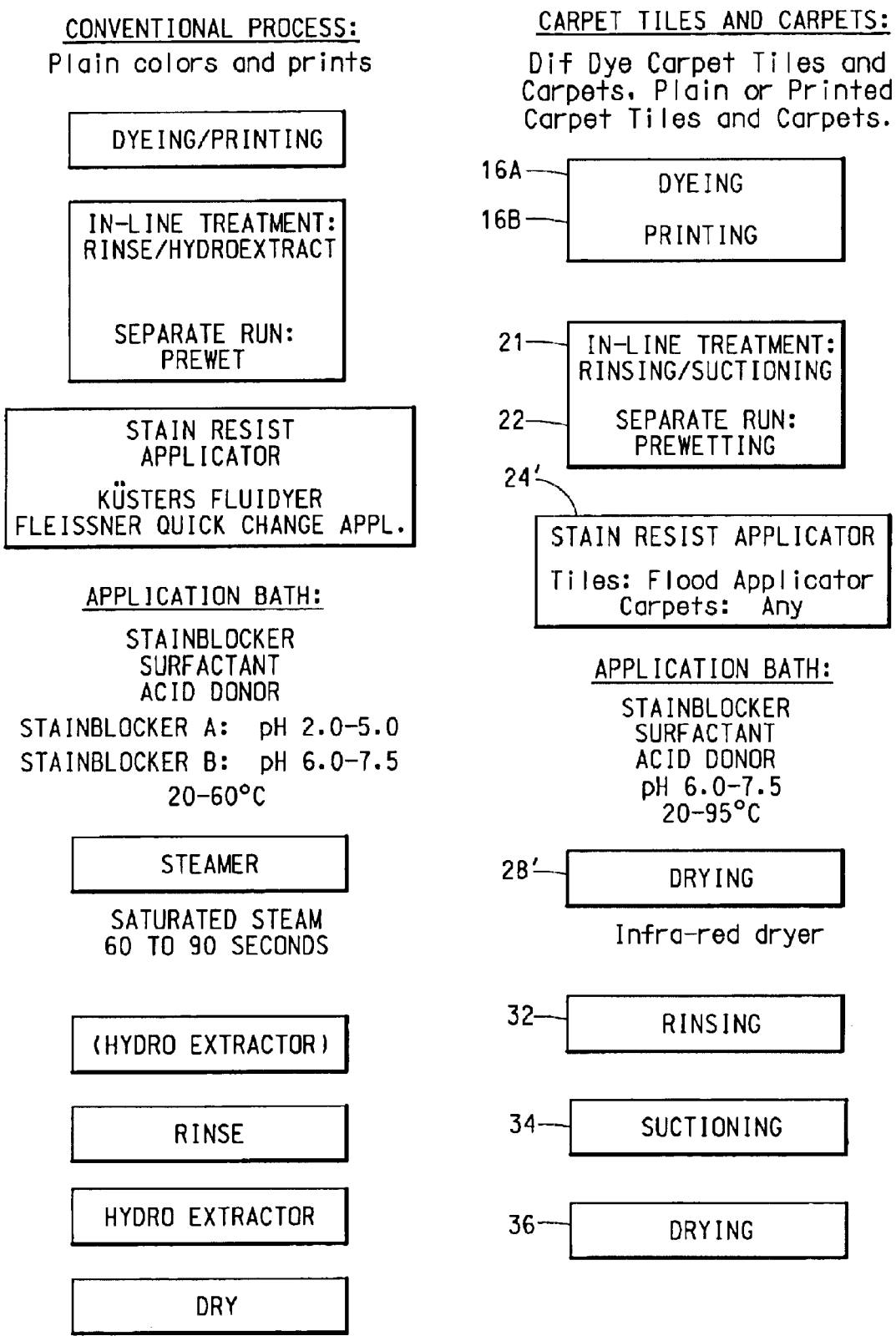

The "infra-red" process by which the pile surface structure (or the textile surface of any article) is described in connection with the schematic representation of FIG. 2 and the corresponding block diagram representation extending along the right hand portion of FIG. 3. In the infra-red process embodiment of the present invention the stainblocker composition is also applied in a continuous, as opposed to batch-wise, manner.

In a typical implementation, after being made using any known carpet-forming process, an undyed pile surface structure 10C is colored in a color applicator 16A (such as a dye bath). The color is fixed in a color fixator 16B (such as a steamer). If the pile surface structure 10C is formed from differentially dyeable yarns, the dye bath contains a mixture of both acid dyestuffs and cationic dyestuffs. The acid dyeable nylon yarns and the cat dyeable nylon yarns that form the pile elements are each colored by the appropriate dyestuff so that both types of yarns may contribute to the visual aesthetic properties of the pile surface structure.

On the other hand, if the pile surface structure 10C is formed only from acid dyeable yarns, the dye bath contains only acid dyestuffs and the acid-dyeable nylon yarns that form the pile elements are appropriately colored by that dyestuff.

The process conditions for the dye bath are suitable for the dyes chosen for use. Some commercially available acid dyes that may be suitable for use in the dye bath include those sold by Ciba Specialty Chemicals, Inc., Basel, Switzerland, under the trademark Tectilon; by DyStar Textilfarben, Leverkusen, Germany under the trademark Telon; by Clariant (Switzerland) Ltd., Basel, Switzerland under the trademark Nylosan; and by Yorkshire Chemicals, Leeds, UK, under the trademark Nylanthren. Some commercially available cationic dyes that may be suitable for use in the dye bath include those sold by Ciba Specialty Chemicals, Inc., Basel, Switzerland, under the trademark Maxilon; by DyStar Textilfarben, Leverkusen, Germany, under the trademark Astrazon; by Clariant (Switzerland) Ltd., Basel, Switzerland, under the trademark Sandocryl; and by Yorkshire Chemicals, Leeds, UK, under the trademark Sevron.

It should be understood that the dye(s) appropriate for the pile surface structure 10C may also be applied using either a screen printing or a spray printing technique.

After dyeing, if the pile surface structure 10C remains in a broadloom form it is conveyed through the stainblocker application process using a suitable guiding devices typically used in the art. However, it should be understood that it lies within the contemplation of the invention to cut the broadloom carpet (assuming that it is provided with a backing) into tiles before entering the stainblocker application process. To this end devices for backing and cutting the carpet are diagrammatically indicated in the dashed-line path shown in FIG. 2B. It also lies within the contemplation of the invention to cut the broadloom (with backing) into the form of tiles prior to dyeing. If the pile surface structure 10C is cut into tiles (either before or after coloring) the tiles are advanced through the stainblocker application process using any commercially available transport belt conveyor.

The dyed pile surface structure 10C (in either the broadloom or the carpet tile form) passes through a cold water rinsing step 21 and a hydroextraction step 22 to remove residual dyes and chemicals. Any conventional arrangement for suctioning liquid from a carpet may be used to perform the suctioning step. Both these steps are similar to corresponding steps of the conventional continuous process.

If coloring of the pile surface structure occurs at an earlier time, the pile surface structure must be prewet (as at the water rinsing step 21) and the water extracted (as at step 22) before the stainblocker is applied.

After suctioning the pile surface structure passes through an application device 24 here a stainblocker composition (with a surfactant, if used) is applied.

In accordance with the present invention the temperature of the stainblocker composition is in the range from about twenty to about ninety-five degrees Celsius (20 to 95° C.). Preferably the temperature of the stainblocker composition is seventy-five degrees Celsius (75° C.) or higher.

For pile surface structure in the form of carpet tiles that are lying loosely on the transport belt a suitable system useful for the application step 24 is a flood applicator such as that manufactured by Eduard Kuesters Maschinenfabrik GmbH & Co. KG, Krefeld, Germany ("Kuesters"). By the term "flood applicator" it is meant that a running line of dyed carpet tiles is passed through a "gutter" that contains the stainblocker composition. A calculated amount of stainblocker composition is applied continuously by the "waterfall/weir" principle onto the carpet.

For a pile surface structure in the form of a broadloom carpet held by the guiding device, the stainblocker composition can be applied by any appropriate application device, such as: a dip trough (with nip rolls at the delivery end); a flood applicator; a foam applicator; the device manufactured by Kuesters and sold as "Flexnip"; or, the device manufactured by Kuesters and sold as "Fluidyer".

The speed of the transport mechanism controls the time during which the pile surface structure is within the bath. For broadloom carpet, transport speed in the range from eight to fifteen (8 to 15) meters per minute is sufficient to keep the broadloom carpet within the bath for an appropriate period of time. For carpet tiles, transport speed in the range from two to five (2 to 5) meters per minute is sufficient to keep each tile within the bath for an appropriate period of time.

As to the stainblocker compositions themselves, sulphone resole type stainblocker compositions with nonionic functionality (in the appropriate weight percentages and with appropriate pH adjustment) are preferred. Anionic functionalized type stainblocker compositions (also in the appropriate weight percentages and with appropriate pH adjustment) may also be used. As earlier discussed the pH of the treatment bath may be adjusted by known acid donor additives such as acetic acid, citric acid and sulfamic acid. Preferred surfactants again include appropriate amounts of an alkylated diphenyl oxide disulfonate sodium salt, alone or in combination with an alkylnaphtalene sulfonic acid formaldehyde condensate sodium salt.

When the stainblocker composition is of the sulphone resole type having nonionic functionality the stainblocker composition is present between one and one-half percent (1.5%) and six percent (6%) based on the weight of the nylon yarns, and the pH of the stainblocker bath is between six (6) and seven and one-half (7.5).

After exiting the applicator 24 the pile surface structure (either broadloom or tiles) is passed through a drying zone 28. Conveniently, the drying zone 28 is defined within a heating device. The temperature within the drying zone is in the range from seventy-five degrees Celsius to ninety-five degrees Celsius (75–95° C.). More preferably, the temperature within the drying zone is in the range from eighty to eighty-five degrees Celsius (80–85° C.).

In the drying zone 28 the stainblocker composition is allowed to react with the nylon yarn in the textile surface. It is while the pile surface structure is heated to the temperature of the drying zone [i.e., in the range from seventy-five degrees Celsius to ninety-five degrees Celsius (75–95° C.), and more preferably, in the range from eighty to eighty-five degrees Celsius (80–85° C.)] that the fiber structure becomes very open and the stainblocker is allowed to react with the fiber. The pile surface structure should remain in this temperature environment for a time sufficient to permit the stainblocker to enter into and react with the nylon yarn in the textile surface, without the dye bleeding from the fiber. The time required for the pile surface structure to reach this temperature depends upon the temperature of the stainblocker composition bath and the speed of the pile surface structure through the process. For typical stainblocker temperatures and transport speeds this residence time is in the range from about five (5) to about twenty (20) seconds, and more preferably, in the range from about ten (10) to about fifteen (15) seconds In the preferred instance infra-red energy is used to raise the temperature of the carpet in the drying zone. Suitable for use as the heating device within which the drying zone is defined is an infra-red oven such as that manufactured by Babcock Textilmaschinen GmbH, Seevetal, Germany; Brueckner Trockentechnik GmbH and Co., KG, Leonberg, Germany; or Fleissner GmbH and Co., Egelsbach, Germany.

It should be noted that in accordance with this invention the pile surface structure is not subjected to a steaming step where bleeding of cationic dyestuff from the cat dyeable yarn would occur, as in the conventional continuous process.

After undergoing treatment in the application device 24 and drying in the heating device 28 the pile surface structure is subjected to the conventional finishing steps normally used in the continuous process. Such finishing steps would include a cold water rinse operation 32 and a suction operations 34. A suction operation before the cold rinse could also be performed. Finally, the pile surface structure is dried in a drying oven 36 and suitably collected, as by a take-up roll (in the case of a broadloom carpet) or a collection bin (in the case of carpet tiles). The take-up or collection bin is not illustrated in FIG. 2B.

If desired, after final drying in the oven 36, a broadloom carpet may be backed and then cut into tiles of desired size.

EXAMPLES

Test Methods The following test methods were used in the Examples below to measure carpet samples made according to the invention as well as control samples for stain resistance, color stability and dyelightfastness.

Kool-Aid® Soft Drink Stain Resistance Standard Test (Standardized AATCC Test Method 175-1991: Red 40 Stain Rating Scale) This impact tester method simulates a "household accident" with a spill dropped from table height onto a carpet.

Staining Agent: The staining agent is a ninety (90) gram per thousand (1000) cc water solution of cherry-flavored, sugar-sweetened Kool-Aid® soft drink. The solution is permitted to reach room temperature (22±2° C.) before use. An alternative staining agent is a solution containing 0.1 gram/liter FD&C Food Red 40 dyestuff, one (1) gram/liter citric acid, and ten (10) gram/liter sugar.

Equipment: A specially designed impact tester is used to apply the staining agent to the specimens under test. The impact tester comprises a cylinder (of plastic or glass) that is 28 cm high with a 6.5 cm inside diameter. A massive piston nine (9 ) cm in length weighing four hundred (400) grams is received on the inside of the cylinder. The piston is made from a plastic material (PVC or PTFE). The piston is vertically movable within the cylinder by a bolt fitted to the piston. The bolt projects through a four (4) mm vertical slot in the cylinder. A small (seven (7) mm diameter) hole is drilled through the cylinder two cm from the bottom for injecting staining agent.

Procedure: Test samples, measuring ten (10) cm square, are cut from each pile surface structure under test. The impact tester is centered on each sample and the plastic piston lifted and fixed in position by the bolt in the slot. Using a syringe twenty (20) cc of the staining agent is injected through the small hole over the surface of the sample. The plastic piston is released and drops freely onto the carpet sample. The impact corresponds to the impact of a cup of liquid falling from the table height [eighty (80) cm]. The impact tester is removed and the sample is left, undisturbed, in a horizontal position for twenty-four (24±4) hours. Without damaging the pile, the sample is rinsed thoroughly with tap water at about twenty degrees Celsius (20° C.), centrifuged to remove any excess water and dried in a forced air oven at maximum of seventy-five degrees Celsius (75° C.).

Each sample is evaluated for staining, using the AATCC Red 40 Stain Scale. According to this scale stains are rated on a scale of 1 to 10, with "1" designating heavy staining and "10" designating no staining. A sample receiving a rating of "9" is considered to have acceptable stain resistance.

Coffee Stain Resistance Standard Test This test is substantially identical to the Kool-Aid® soft drink test, except that the staining agent is a twenty gram per liter (20 g/l) solution of an instant coffee (e.g. Nescafe® Gold coffee, with no additives such as milk, cream or sugar) at a temperature of sixty degrees Celsius (60° C.).

Color Measurement Color measurements were made using the international standard color measurement method promulgated by "Commission Internationale de L'Eclairage" (Paris, France), (International Society for Illumination/Lighting), ("CIE") using standard color coordinates of both the CIELAB L*a*b* and the CIELAB L*C*h color space: "L" designates the lightness coordinate; "a" designates the red/green coordinate (+a indicating red, −a indicating green); "b" designates the yellow/blue coordinate (+b indicating yellow, −b indicating blue); and "C" designates the chroma coordinate, the perpendicular distance from the lightness axis (more distance indicating more chroma).

Dyefastness Dyelightfastness is measured according to standardized test method DIN 54004 (ISO 105 B02). This method is based on scale of 1 to 8, according to standardized "bluescale" of eight different blue wool dyestuffs, dyed on a wool fabric, which are joint into the light exposure process together with the test specimen (1-very poor, 8-very high lightfastness).

Examples 1a–1c

Examples 1a–1c were performed to demonstrate the invention on overprinted carpet tiles. The carpet tiles were made of acid dyeable yarn.

In all of Examples 1a–1c the stainblocker was ZELAN® 8236 and the surfactant ZELAN® 50. The amount of ZELAN® 8236 was 5.0% of pile weight, the wet pickup was 400%. pH values were adjusted with citric acid to 6.3. The stainblocker composition was applied by flood process at a temperature of seventy-six degrees Celsius (76° C.). The tiles were cured for ten (10) seconds at eighty degrees Celsius (80° C.) in an infra-red heater. In all of Examples 1a–c the residual moisture after printing was forty percent (40%). Example 1a was one hundred percent (100%) overprinted before treating with the stainblocker composition. Example 1b was forty percent (40%) overprinted and Example 1c was an un-overprinted control carpet. After treating the tile sample pieces 1a–1c were water rinsed, extracted and dried.

After dyeing, the tile sample pieces were each tested for stainblocker performance (Kool-Aid test: cold rinsed, coffee test: after cleaned) by standard test methods. The results are reported in Table 1.

As can be seen the stainblocker results of Examples 1a, 1b, and 1c were excellent.

TABLE 1

| Example No. | Kool-Aid Cold rinsed | Coffee After cleaned |
|---|---|---|
| 1a | 10 | 10 |
| 1b | 10 | 10 |
| 1c | 10 | 9–10 |

Discussion of Results In all three examples application of the stainblocker composition using a flood applicator and an infra-red oven in accordance with the present invention resulted in all cases in excellent stainblocking results.

Examples 2a–2d

Examples 2a–2d were performed to demonstrate the invention on differentially dyeable nylon carpets. The carpet in Examples 2a–2d was a loop construction containing three different filament yarn types having deep acid, regular cationic, and light cationic dyeabilities. The carpet was of blue (acid dyeable yarn) and orange (cationic dyeable yarn) color. Example 2a was treated by conventional winch/beck process. Example 2b was treated by conventional continuous application. Example 2c was treated by the infra-red process of the present invention. Example 2d was an untreated control carpet.

In all of Examples 2a–2c ZELAN® 8236 (DuPont) as stainblocker and ZELAN® 50 (DuPont) as surfactant were used. In Examples 2a and 2b the amount of ZELAN® 8236 was 5.5% and in Example 2c the amount of ZELAN® 8236 was 3.0% of carpet pile weight. pH values were adjusted with acetic acid. Example 2a was treated for twenty minutes at pH 6.8 and at a temperature of seventy-five degrees Celsius (75° C.). Example 2b was treated at pH 6.8 and steamed afterwards. The wet pick-up was 450%. Example 2c was treated as described above at a pH of 6.8. Example 2d was treated in order to compare stainblocking performance, color stability and dyelightfastnesses.

After treating the carpet sample pieces 5a–5c were water rinsed, hydroextracted and dried.

After drying, the carpet sample pieces were each tested for Kool-Aid staining, color stability and dyelightfastness by the test methods described above. The results are reported in Table 2.

TABLE 2

| Example No. | Kool-Aid | C* | Dyelightfastness |
|---|---|---|---|
| 5a | 10 | 11.12 | 5–6 |
| 5b | 10 | 13.96 | 5–6 |
| 5c | 10 | 15.87 | 6 |
| 5d | 1–2 | 16.44 | 6 |

C* value (saturation, the higher the C* value the richer is the color)

Discussion of Results As can be seen (compare Examples 2a, 2b to 2c and 2a, 2b, 2c to 2d) the infra-red process-treated carpet sample 2c shows the same excellent stain-blocking results although a smaller amount of stainblocker has been used. These results (compare Examples 2a, 2b, 2c to 2d) also show smallest deviation in color saturation (C* values) of carpet specimen 2c. Also, as can be seen by comparing Examples 2a, 2b and 2c to 2d, the dyelightfastnesses at all application methods are good.

What is claimed is:

1. A method for treating an article having a textile surface with a stainblocker composition, the textile surface being formed from at least two types of dyeable nylon yarns, wherein at least one type of nylon yarn is dyeable by an acid dyestuff and at least one other type of nylon yarn is dyeable by a cationic dyestuff, the method comprising the steps of:

(a) coloring the textile surface of the article with at least an acid dyestuff and a cationic dyestuff;

(b) applying a stainblocker composition to the textile surface of the article, the stainblocker composition having a temperature from twenty to ninety-five degrees Celsius (20 to 95° C.);

(c) using infra-red energy to dry the article in a drying zone having a temperature in the range from seventy-five degrees Celsius to ninety-five degrees Celsius (75–95° C.) for a time sufficient to allow the stainblocker composition to react with the nylon yarn in the textile surface; and (d) rinsing the textile surface of the article with water, and thereafter drying the same, such that substantially the entire textile surface of the article is coated with a stainblocker composition whereby the textile surface has a stain resistance of 9 or higher on the AATCC Red 40 Stain Scale.

2. The method of claim 1 wherein the article is a carpet tile, and wherein, in step (b) the stainblocker composition is applied using a flood process, such that substantially the entire textile surface of the carpet tile is coated with a stainblocker composition whereby the textile surface of the carpet tile has a stain resistance of 9 or higher on the AATCC Red 40 Stain Scale.

3. The method of claims 1 or 2 wherein the temperature of the drying zone is in the range from eighty degrees Celsius to eighty-five degrees Celsius (80–85° C.).

4. The method of claim 2 wherein the article is conveyed on a conveyor, and wherein the flood process is used to apply the stainblocker composition to the textile surface of the article on the conveyor.

5. The method of claim 1 wherein, before step a) further comprising the step of:

cutting the textile article into tiles of a predetermined size, and wherein in step (b) the stainblocker composition is applied using a flood process, such that substantially the entire textile surface of each tile is coated with a stainblocker composition whereby the textile surface has a stain resistance of 9 or higher on the AATCC Red 40 Stain Scale.

6. The method of claim 1 wherein, after step a) and before step b), further comprising the step of:

cutting the textile article into tiles of a predetermined size, and wherein in step (b) the stainblocker composition is applied using a flood process, such that substantially the entire textile surface of each tile is coated with a stainblocker composition whereby the textile surface has a stain resistance of 9 or higher on the AATCC Red 40 Stain Scale.

7. The method of claim 1 wherein, after step d), further comprising the step of:

cutting the textile article into tiles of a predetermined size such that substantially the entire textile surface of each tile is coated with a stainblocker composition whereby the textile surface has a stain resistance of 9 or higher on the AATCC Red 40 Stain Scale.

8. The method of claims 1, or 2 wherein the textile article is a pile surface structure having a plurality of pile elements thereon, the pile elements being formed from the first and the second types of nylon yarn, wherein substantially the entire height of each pile element is coated with a stainblocker composition whereby the pile surface structure has a stain resistance of 9 or higher on the AATCC Stain Rating Scale 40.

9. The method of claims 1, or 2 wherein the stainblocker composition is of the anionic functionalized type.

10. The method of claim 9 wherein the stainblocker composition is selected from the group consisting of sulphonated phenol formaldehyde condensate type, maleic acid anhydride type, acrylate dispersions and mixtures thereof; the stainblocker is present between three percent (3%) and five percent (5%) based on the weight of the nylon yarns; and the pH of the stainblocker bath is between two (2) and five (5).

11. The method of claims 1, or 2 wherein the stainblocker composition is of the sulphone resole type having nonionic functionality.

12. The method of claim 11 wherein the stainblocker composition is present between one and one-half percent (1.5%) and six percent (6%) based on the weight of the nylon yarns, and the pH of the stainblocker bath is between six (6) and seven and one-half (7.5).

13. The method of claims 1, or 2 wherein the two types of dyeable nylon yarns are bulked continuous filament yarns.

14. The method of claims 1, or 2 wherein the two types of dyeable nylon yarns are staple spun yarns.

15. The method of claim 8 wherein at least some of the pile elements are formed from both a nylon yarn dyeable by an acid dyestuff and a nylon yarn dyeable by a cationic dyestuff.

16. The method of claim 8 wherein at least some of the pile elements are formed from a nylon yarn dyeable by an acid dyestuff and at least others of the pile elements are formed from a nylon yarn dyeable by a cationic dyestuff.

17. The method of claim 12 wherein the stainblocker composition is present between two percent (2%) and three percent (3%) based on the weight of the nylon yarns.

* * * * *